US009121202B2

(12) United States Patent
Burciaga et al.

(10) Patent No.: US 9,121,202 B2
(45) Date of Patent: Sep. 1, 2015

(54) POWER LOCK-UNLOCK WITH IMPATIENT PASSENGER MECHANISM

(71) Applicants: Fernando Burciaga, Cd. Juárez (MX); Adrian Sinai Perez Mora, Cd. Juárez (MX); Luis Ricardo Martinez, Cd. Juárez (MX); Francisco Javier Vazquez, Cd. Juárez (MX)

(72) Inventors: Fernando Burciaga, Cd. Juárez (MX); Adrian Sinai Perez Mora, Cd. Juárez (MX); Luis Ricardo Martinez, Cd. Juárez (MX); Francisco Javier Vazquez, Cd. Juárez (MX)

(73) Assignee: INTEVA PRODUCTS, LLC, Troy, MI (US)

( * ) Notice: Subject to any disclaimer, the term of this patent is extended or adjusted under 35 U.S.C. 154(b) by 158 days.

(21) Appl. No.: 13/723,305

(22) Filed: Dec. 21, 2012

(65) Prior Publication Data

US 2013/0161961 A1 Jun. 27, 2013

Related U.S. Application Data

(60) Provisional application No. 61/579,877, filed on Dec. 23, 2011.

(51) Int. Cl.
*E05C 3/06* (2006.01)
*E05B 77/32* (2014.01)
(Continued)

(52) U.S. Cl.
CPC ..... *E05B 77/32* (2013.01); *E05B 81/06* (2013.01); *E05B 81/16* (2013.01); *E05B 81/34* (2013.01); *E05B 81/44* (2013.01); *E05B 2015/0468* (2013.01); *Y10T 292/0949* (2015.04)

(58) Field of Classification Search
CPC ..... E05B 77/32; E05B 81/06; E05B 81/16; E05B 81/34; E05B 81/44; E05B 2015/0468
USPC ..... 292/100, 201, 216, DIG. 23
See application file for complete search history.

(56) References Cited

U.S. PATENT DOCUMENTS 5,803,515 A * 9/1998 Arabia et al. ..... 292/216
5,934,717 A 8/1999 Wirths et al.
(Continued)

FOREIGN PATENT DOCUMENTS

CN 1699717 A 11/2005
CN 101463684 A 6/2009
(Continued)

OTHER PUBLICATIONS

First Office Action for Chinese Patent Application No. 201210563146.8.
(Continued)

*Primary Examiner* — Kristina Fulton
*Assistant Examiner* — Christine M Mills
(74) *Attorney, Agent, or Firm* — Cantor Colburn LLP

(57) ABSTRACT

A latch including a locking lever pivotally mounted to the latch. The latch also including an intermittent lever pivotally coupled to the locking lever at a first end, wherein movement of the locking lever causes a movement of the intermittent lever. A gear is pivotally coupled to a second end of the locking lever such that rotation of the gear causes movement of the locking lever. The locking lever is formed from a resilient material and has an area of reduced thickness reproducing a spring effect. Movement of the second end of the locking lever with respect to the first end of the locking lever creates a biasing force in the locking lever.

18 Claims, 6 Drawing Sheets

(51) Int. Cl.

| | |
|---|---|
| ***E05B 81/16*** | (2014.01) |
| ***E05B 81/06*** | (2014.01) |
| ***E05B 81/44*** | (2014.01) |
| ***E05B 81/34*** | (2014.01) |
| *E05B 15/04* | (2006.01) |

(56) References Cited

U.S. PATENT DOCUMENTS

| | | | | |
|---|---|---|---|---|
| 6,076,868 | A | 6/2000 | Roger, Jr. et al. | |
| 6,126,212 | A * | 10/2000 | Fujihara | 292/216 |
| 6,371,538 | B1 | 4/2002 | Inoue | |
| 6,511,106 | B2 * | 1/2003 | Perkins et al. | 292/216 |
| 6,565,132 | B2 | 5/2003 | Mork et al. | |
| 7,192,066 | B2 | 3/2007 | Ilea et al. | |
| 7,543,861 | B2 * | 6/2009 | Dupont et al. | 292/216 |
| 8,182,004 | B2 | 5/2012 | Yoda | |
| 8,684,424 | B2 | 4/2014 | Wattebled et al. | |
| 2004/0113438 | A1 | 6/2004 | Kachouh | |
| 2005/0212302 | A1 | 9/2005 | Fisher | |
| 2009/0160198 | A1 | 6/2009 | Yoda | |
| 2010/0170308 | A1 | 7/2010 | Wattebled et al. | |

FOREIGN PATENT DOCUMENTS

| | | | |
|---|---|---|---|
| CN | 101680246 | A | 3/2010 |
| GB | 2412405 | A | 9/2005 |

OTHER PUBLICATIONS

English Translation for CN101680246 Abstract.
English Translation for CN101463684 Abstract.
English Translation for CN1699717 Abstract.

* cited by examiner

POWER LOCK-UNLOCK WITH IMPATIENT PASSENGER MECHANISM

CROSS REFERENCE TO RELATED APPLICATIONS

This application claims the benefit of U.S. Provisional Patent Application No. 61/579,877 filed, Dec. 23, 2011, the contents of which are incorporated herein by reference thereto.

TECHNICAL FIELD

Exemplary embodiments of the present invention relate generally to latch mechanisms and, more particularly, to latch mechanisms having a power lock.

BACKGROUND

Latches, such as those used in vehicles commonly employ a power lock system as a convenience feature. The power lock system may use an electrically powered actuator associated with multiple components of the vehicle such as a door latch or the trunk latch, to move the lock between a locked and an unlocked position. To protect the components of the door latch, most door latches are of the freewheeling type such that when the door latch is in the locked position, the door latch does not exert any resistance to actuation of a connected release handle. However, most freewheeling door latches are configured in such a manner that if the latch is in a locked position, the door latch cannot be unlatched if the door handle is pulled before or at the same time that power is applied.

In a common situation, a person will try to open a handle connected to a latch, such as a handle on a lift gate for example, before the latch has been unlocked. Subsequently or simultaneously, the person will attempt to unlock the latch but will not be able to do so since the handle is pulled. After the person lets go of the handle, the unlock mechanism must again be actuated to unlock the door. Thereafter, the person may pull on the handle again to gain access to the vehicle.

Accordingly, it is desirable to provide a latch wherein if the handle is pulled and the latch is unlocked simultaneously, the unlock mechanism need not be actuated again to open the latch.

SUMMARY OF THE INVENTION

According to an exemplary embodiment of the present invention, a latch is provided including a locking lever pivotally mounted to the latch. An intermittent lever is pivotally coupled to the locking lever proximate to a first end of the locking lever. Movement of the locking lever causes a corresponding movement of the intermittent lever. A gear is pivotally coupled to the locking lever proximate to a second end of the locking lever. Rotation of the gear causes the locking lever to move. The locking lever is formed from a resilient material and has an area of reduced thickness as opposed to the first end and the second end. Movement of the second end of the locking lever with respect to the first end will create a biasing force in the locking lever.

According to another embodiment of the present invention, a method for preventing misalignment of a latch during an unlock operation is provided including compressing a locking lever so as to create a biasing force. A handle is then released. Engagement between a blocking member and a blocking pin is maintained until an intermittent lever is in a normal position. Once in the normal position, the intermittent lever is slid into an unlocked position.

According to yet another embodiment of the present invention, a latch is provided including a locking lever pivotally mounted to a housing of the latch. An intermittent lever is pivotally coupled to a locking lever proximate to a first end of the locking lever. A gear is pivotally coupled to a second end of the locking lever such that rotational movement of the gear causes movement of the locking lever which causes a corresponding movement of the intermittent lever. The gear is rotated by a motor. A release lever is pivotally mounted to the housing and operably coupled to a handle external to the housing. The intermittent lever is slidably mounted to the release lever via a pin integrally formed with the release lever. The locking lever is formed from a resilient material and is configured to have an area of reduced thickness as opposed to the first end and second end of the locking lever such that movement of the second end of the locking lever relative to the first end creates a biasing force in the locking lever. The biasing force in the locking lever will cause the intermittent lever to move relative to the housing after a motor after the motor has been de-energized and the release lever has been rotated by the handle prior to rotational movement of the gear by the motor.

The above-described and other features and advantages of the present invention will be appreciated and understood by those skilled in the art from the following detailed description, drawings, and appended claims.

BRIEF DESCRIPTION OF THE DRAWINGS

Embodiments of the present invention will now be described, by way of example only, with reference to the accompanying drawings in which.

DETAILED DESCRIPTION

Reference is made to the following U.S. Pat. Nos. 5,934,717; 6,076,868; 6,565,132; and 7,192,066 the contents each of which are incorporated herein by reference thereto.

Figure 6:
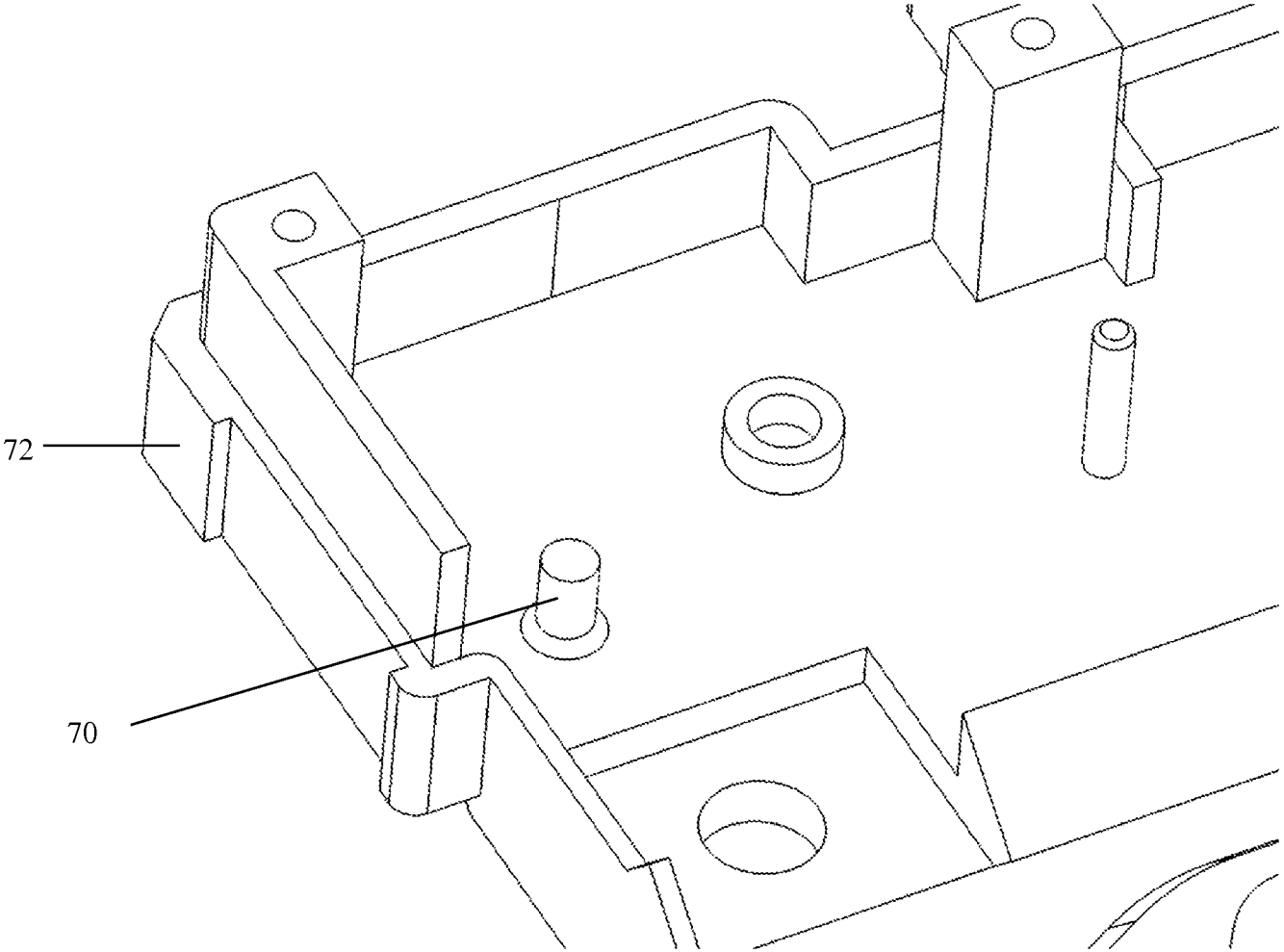
FIG. 6 is a perspective view of a portion of the housing of the present invention.

Referring to the FIGS., portions of a latch 20 in accordance with one exemplary embodiment is illustrated. The latch 20 includes a locking assembly 30, movable between a locked and an unlocked position, and a latching assembly 80, movable between a latched and an unlatched position, positioned within a housing 72 (see at least FIG. 6) and illustrated schematically in FIGS. 1-4. This latch 20 may be integrated into a component of a vehicle, such as the vehicle structure adjacent a lift gate, trunk, door, or any other operable component for example.

The latching assembly 80 includes a fork bolt 90 and a cooperating detent lever 82. The fork bolt 90 and the detent lever 82 are pivotally mounted to the housing 72 or other structure by a stud positioned in holes 102 and 88 respectively. The fork bolt 90 is biased in the direction of arrow F by a coil spring (not shown) and the detent lever 82 is biased in the direction of arrow D into engagement with the fork bolt 90 by a second coil spring (not shown). The fork bolt 90 has slot or throat 92 for receiving and retaining a striker (not shown) located on a complementary vehicle component, such as a lift gate or trunk. The fork bolt 90 also includes a primary shoulder 100, an intermediate secondary shoulder 98, and a radially projecting foot 96. The detent lever 82 has a sector shaped catch 84 that engages the radially projecting foot 96 when the fork bolt 90 is in an unlatched position. The sector shaped catch 84 positively engages the primary and secondary latch shoulders 100, 96 to hold the fork bolt 90 against the bias of the spring in either a primary or secondary latched position respectively. The aforementioned fork bolt and detent lever are provided as a non-limiting embodiment. Numerous other types or configurations of the fork bolt and detent lever are considered to be within the scope of an exemplary embodiment of the present invention.

The intermittent lever 40 of the locking assembly 30 engages the detent lever 82 of the latching assembly 80 to pivot the detent lever 82 between an engaged position and a disengaged position. The foot portion 44 of the intermittent lever 40 contacts a protrusion 86 extending from the planar surface of the detent 82. If the intermittent lever 40 is in an unlocked position such that the foot portion 44 is adjacent the protrusion 86 of the detent, on the same side as the fork bolt 90, rotation of the intermittent lever 40 will cause the detent lever 82 to pivot opposite the direction of arrow D into a disengaged position (See at least FIG. 4).

The locking assembly 30 includes a release lever 32 rotatable about a pin 38 (see FIGS. 4, 5) between a non-actuated and an actuated position. A spring (not shown), such as a coil spring for example, biases the release lever 32 in the direction of arrow R to a non-actuated position. The first end 34 of the release lever 32 is operatively coupled to a handle 110 of the latch, such that if a person applies a force to the handle 110, the force causes the release lever to rotate opposite the direction of arrow R about pin 38. Situated near the second end of the release lever 32 is a retaining pin 36 extending perpendicularly from the surface of the release lever 32. Operably coupled to the release lever 32 is an intermittent lever 40 having a foot portion 44 extending from a first end. The intermittent lever 40 includes an elongated opening 42, extending through the thickness of the intermittent lever 40, disposed adjacent the first end. The retaining pin 36 is located within the elongated opening 42 such that the intermittent lever 40 is slidably and pivotally coupled to the release lever 32. A first end 52 of a locking lever 50 is rotatably coupled to a second end of the intermittent lever 40 at pin 48. Proximate to the second end 54 of the locking lever 50 is a pin 55 extending into an opening 62 of the body of a first gear 60, such as a rotary gear for example. The locking lever 50 is pivotable about a stud disposed in hole 58. Between the first end 52 and the second end 54 of the locking lever 50 is an area 56 of reduced thickness. In an exemplary embodiment, the locking lever 50 is formed from a resilient material such that movement of the second end 54 of the locking lever 50 with respect to the first end 52 of the locking lever 50 creates a biasing force in the locking lever 50.

A second gear 64, such as a worm gear, is coupled to the shaft of a motor 66 and is engaged with the first gear 60 such that energizing the motor 66 will rotate the first gear 60. As the first gear 60 rotates, a sidewall of opening 62 contacts the pin 55 extending from the locking lever 50 into the opening 60. The force applied to pin 55 by a sidewall of opening 62 causes the locking lever 50 to rotate about the stud located in hole 58 such that the first end 52 of the locking lever 50 coupled with the intermittent lever 40 causes the intermittent lever 40 to slide relative to the release lever 32. When the retaining pin 36 is disposed adjacent the lower edge of elongated opening 42 of the intermittent lever 40, the locking assembly 30 is in a locked position because the foot portion 44 of the intermittent lever 40 cannot contact protrusion 86 of the detent lever 82. When the motor is energized such that the locking lever 50 pivots about hole 58 in the direction of arrow L, and the intermittent lever 40 is in a first position such that the foot portion 44 is aligned with protrusion 86 of detent lever 82, the locking lever 50 slides the intermittent lever 40 away from the release lever 32 until the retaining pin 36 is adjacent the top surface of the elongated opening 42. In this unlocked position, the foot portion 44 of the intermittent lever 40 is adjacent protrusion 86 of detent lever 82. If a force is then applied to handle 110 when the intermittent lever 40 is in this position, the rotation of the release lever 32 will cause the foot portion 44 to engage the protrusion 86 and rotate the detent lever 82 out of engagement with the fork bolt 90, thereby allowing the fork bolt 90 to rotate to an unlatched position.

In one embodiment, a blocking post or pin 70 extends from a surface of housing 72 toward the surface of intermittent lever 40. The blocking pin 70 may be formed integrally with the housing 72. Alternately, the blocking pin 70 may be mounted elsewhere within the latch 20. A blocking member 46 extends from the surface of the intermittent lever 40 in the direction of the blocking pin 70. In an exemplary embodiment, the blocking member 46 protrudes from the surface of the intermittent lever 40 adjacent the top edge of elongated opening 42. The blocking member 46 is substantially complementary to the blocking pin 70. The blocking pin 70 does not protrude into the elongated opening 42; therefore the engagement between the blocking member 46 and the blocking pin 70 occurs on a different plane than the engagement between the elongated opening 42 of the intermittent lever 40 and the retaining pin 36 of the release lever 32.

Figure 1:
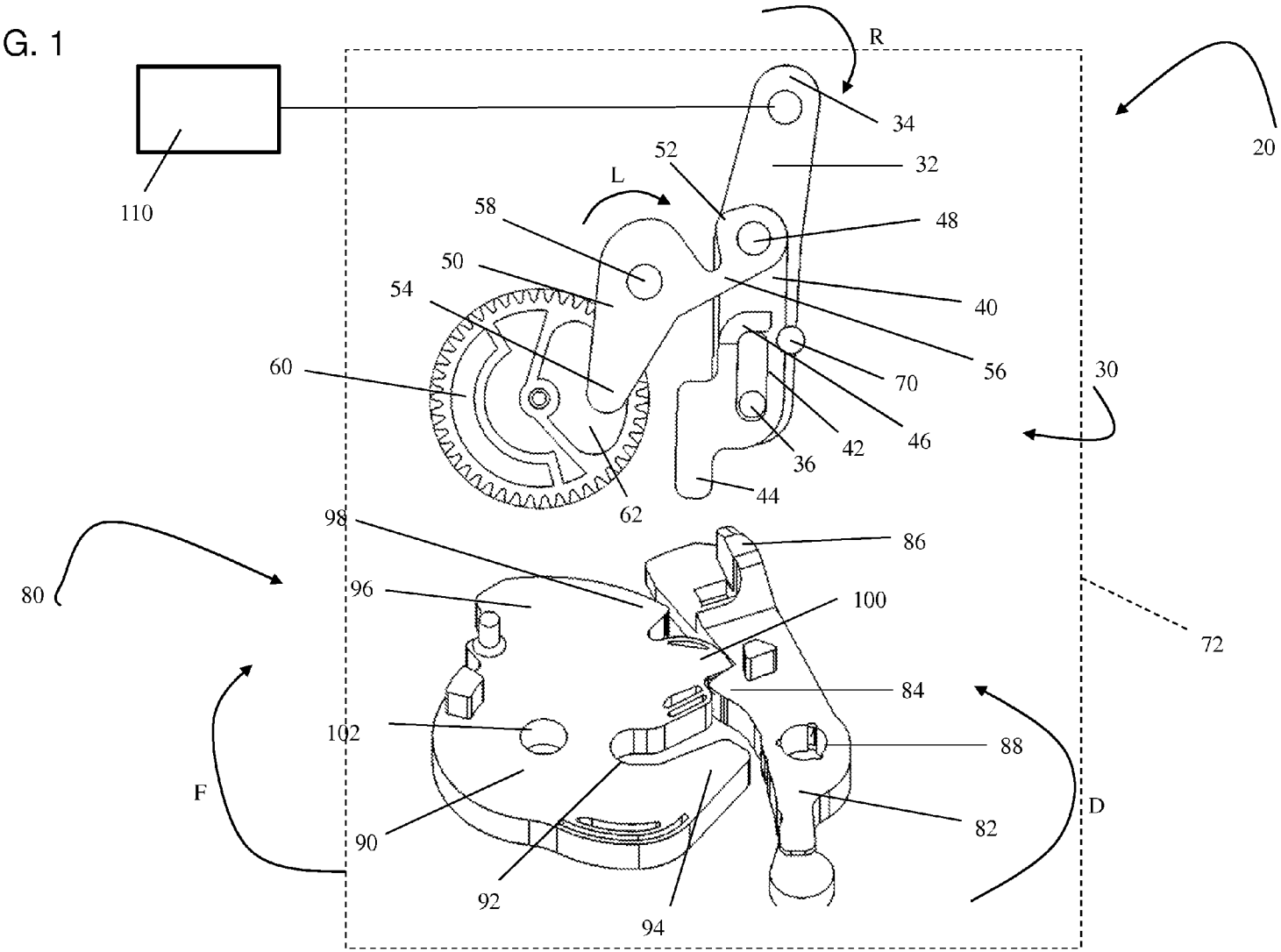
FIG. 1 is a perspective view of an exemplary embodiment of the present invention in a locked state.
Figure 2:
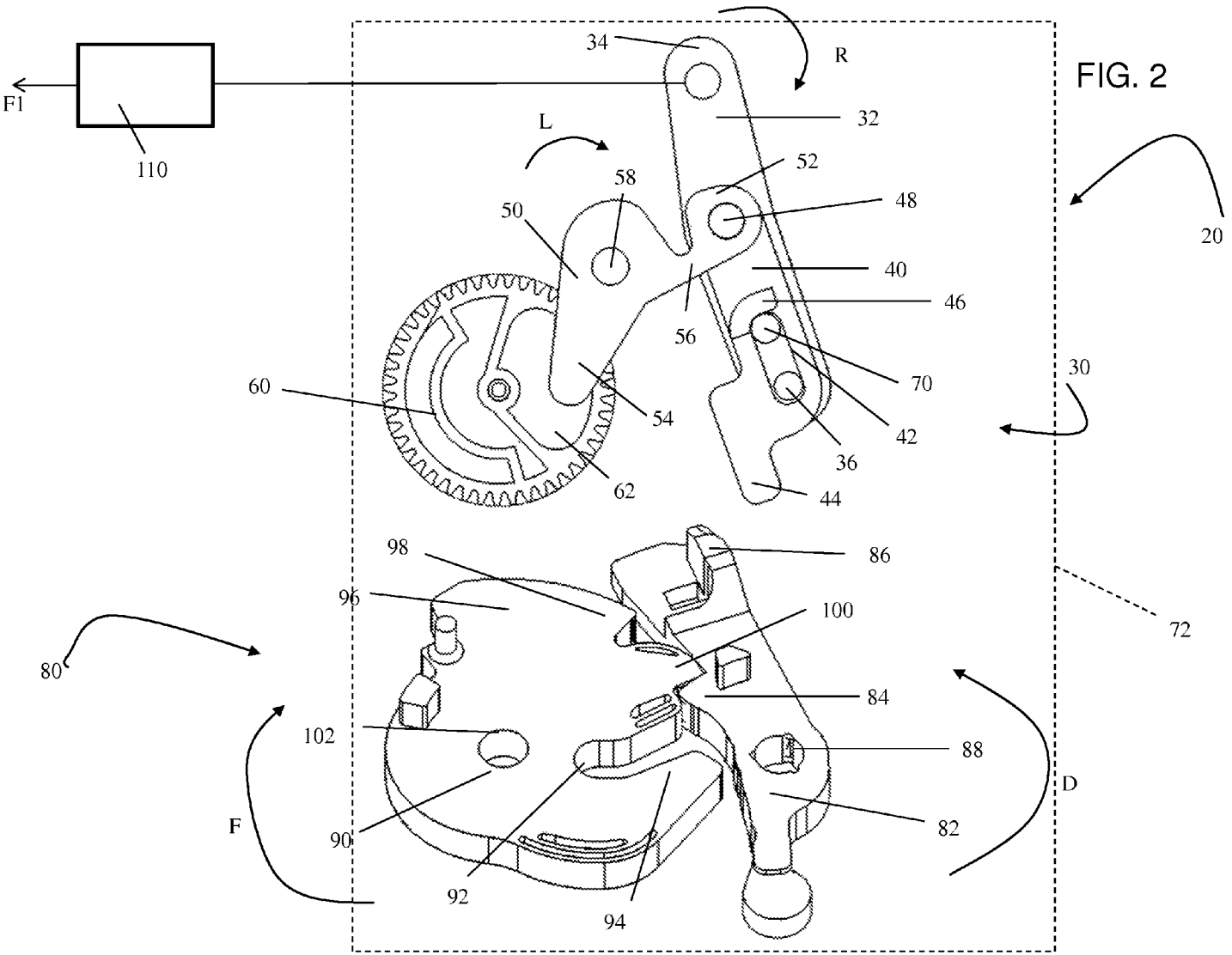
FIG. 2 is a perspective view of an exemplary embodiment of the present invention once a force is applied to the handle of the latch of FIG. 1.

Referring now to FIG. 1, the latch 20 is shown in a locked and latched position, such as when a lift gate is closed and locked. The intermittent lever 40 is in a first position wherein the foot portion 44 of the intermittent lever is aligned with a protrusion 86 of the detent lever 82. When the intermittent lever 40 is in this first position, the blocking member 46 and the blocking pin 70 extending from the housing 72 are not engaged. However, if a force F1 is applied to the handle 110 of the latch 20, as illustrated in FIG. 2, the release lever 32 rotates around pin 38 to an actuated position. Because retaining pin 36 is positioned within elongated opening 42 of the intermittent lever 40, rotation of the release lever 32 to an actuated position causes the intermittent lever 40 to rotate about pin 48 to a second position. Since the latch 20 was locked when the release lever 32 was actuated, the intermittent lever 40 rotates in the locked position, thereby causing the blocking member 46 to contact the blocking pin 70. This engagement limits the rotation of the intermittent lever 40 relative to the locking lever and therefore the rotation of the release lever 32 when the latch 20 is locked.

Figure 3:
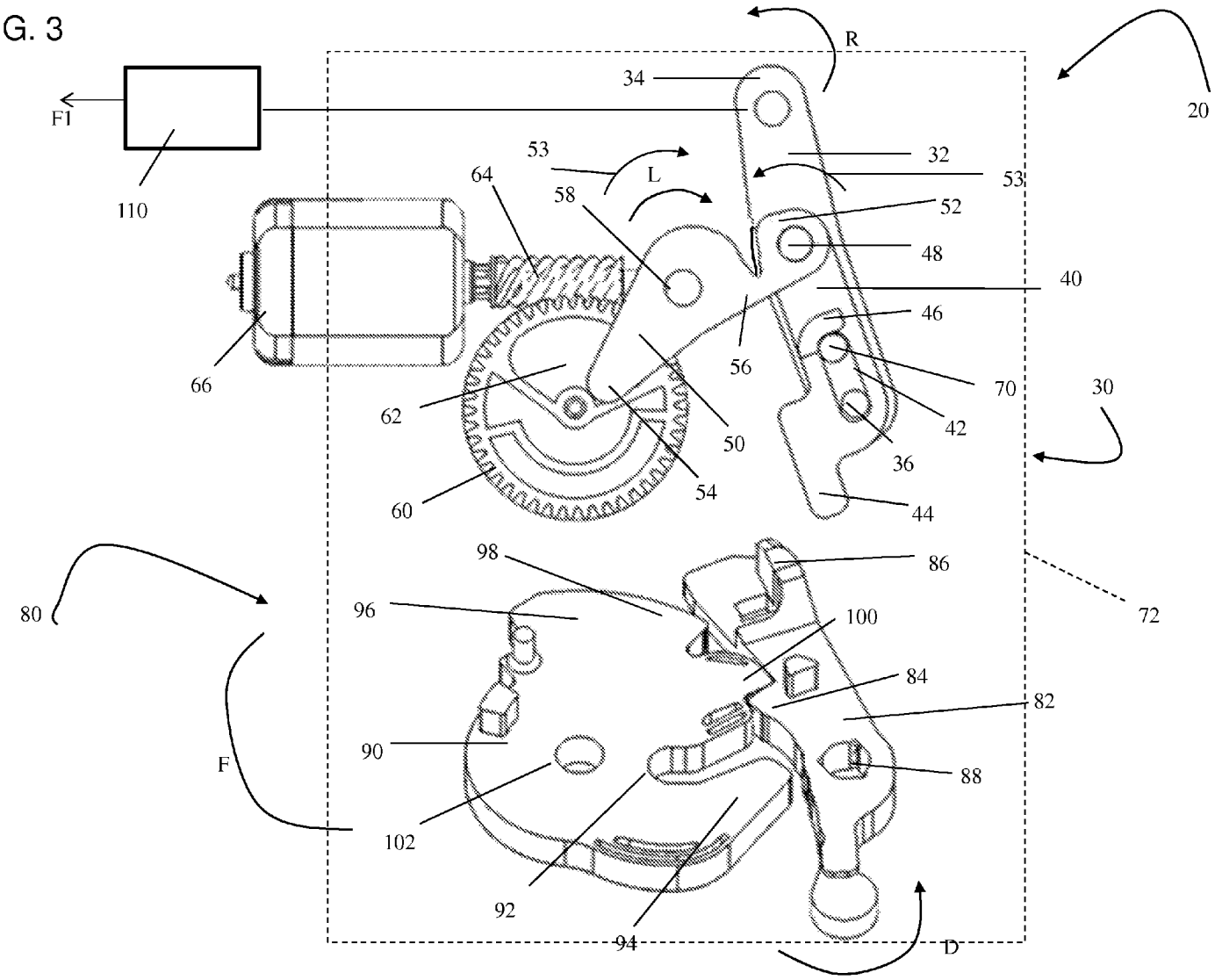
FIG. 3 is a perspective view of the exemplary embodiment of FIG. 2 after the motor is energized to unlock the latch.

Referring now to FIG. 3, if the motor 66 is energized simultaneously with the release lever 32 being actuated, the locking lever 50 compresses. Energizing the motor 66 to slide the intermittent lever 40 into an unlocked position causes a sidewall of the opening 62 in first gear 60 to apply a force on pin 55 such that the locking lever 50 pivots in the direction of arrow L about the stud located in hole 58. Because the blocking member 46 is engaged with the blocking pin 70, the intermittent lever 40 is unable to slide relative to the release lever 32. The rotational force being applied by the gear 60 on the locking lever 50 causes both the second end 54 and the first end 52 to move towards each other due to the resilient characteristics of the material used for lever 50 and thus portion 56 is simultaneously compressed and stretched such that a biasing force is created in locking lever 50 (See at least FIG. 3). In other words, the space above portion 56 is smaller than that illustrated in FIGS. 1, 2 and 4, wherein the first end 52 and the second end 54 are moved towards each other in the directions of arrows 53 thereby creating a biasing force in a direction opposite to arrows 53. In order to create this biasing force portion 56 of lever 50 is formed out of a resilient material capable of being deflected and then returning to its original shape. Non-limiting examples of such a material include but are not limited to, plastics, rubber, elastomeric materials, metals, alloys, and combinations of any of the above.

Figure 4:
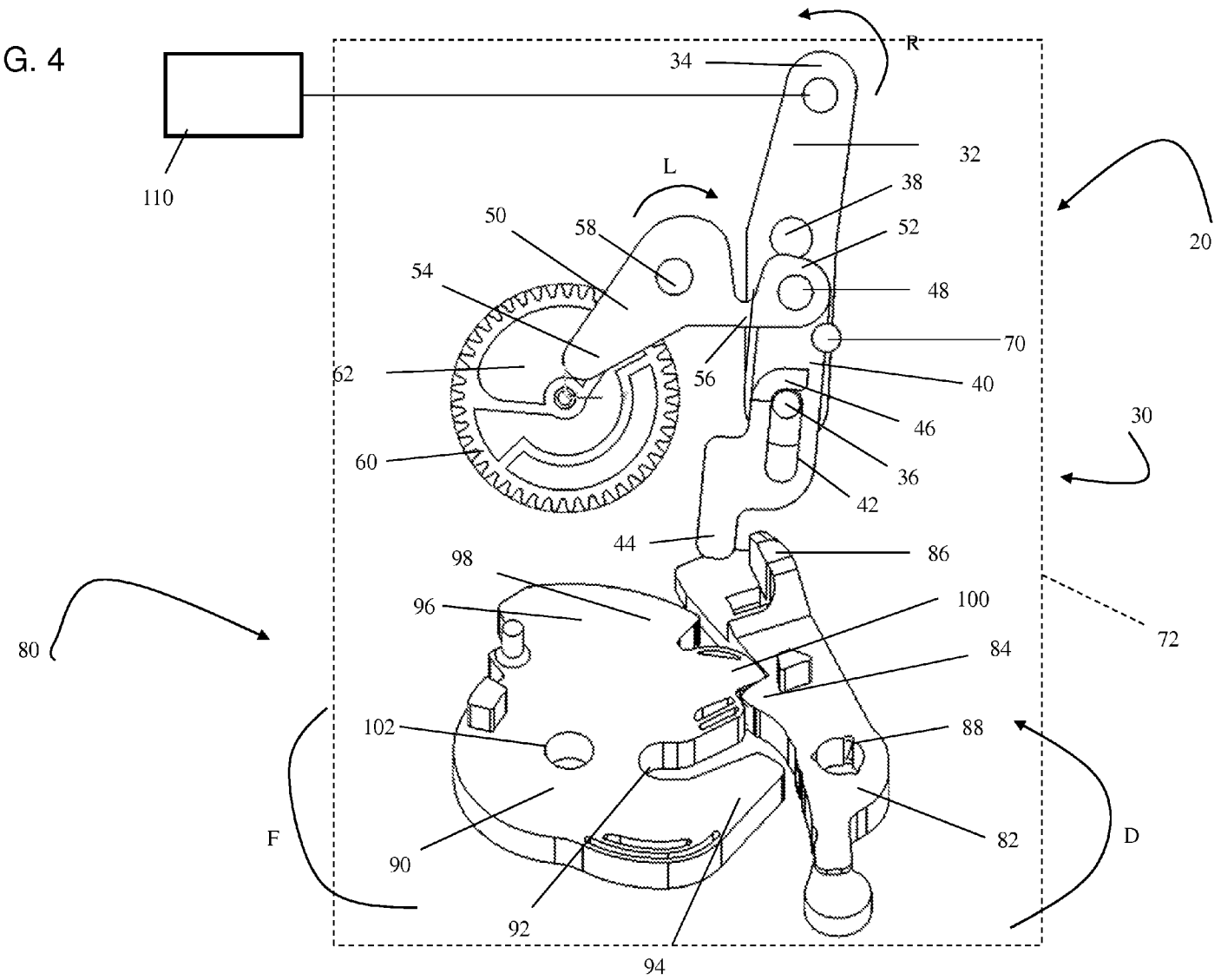
FIG. 4 is a perspective view of the latch illustrated in FIG. 3 after the handle of the latch has been released.
Figure 5:
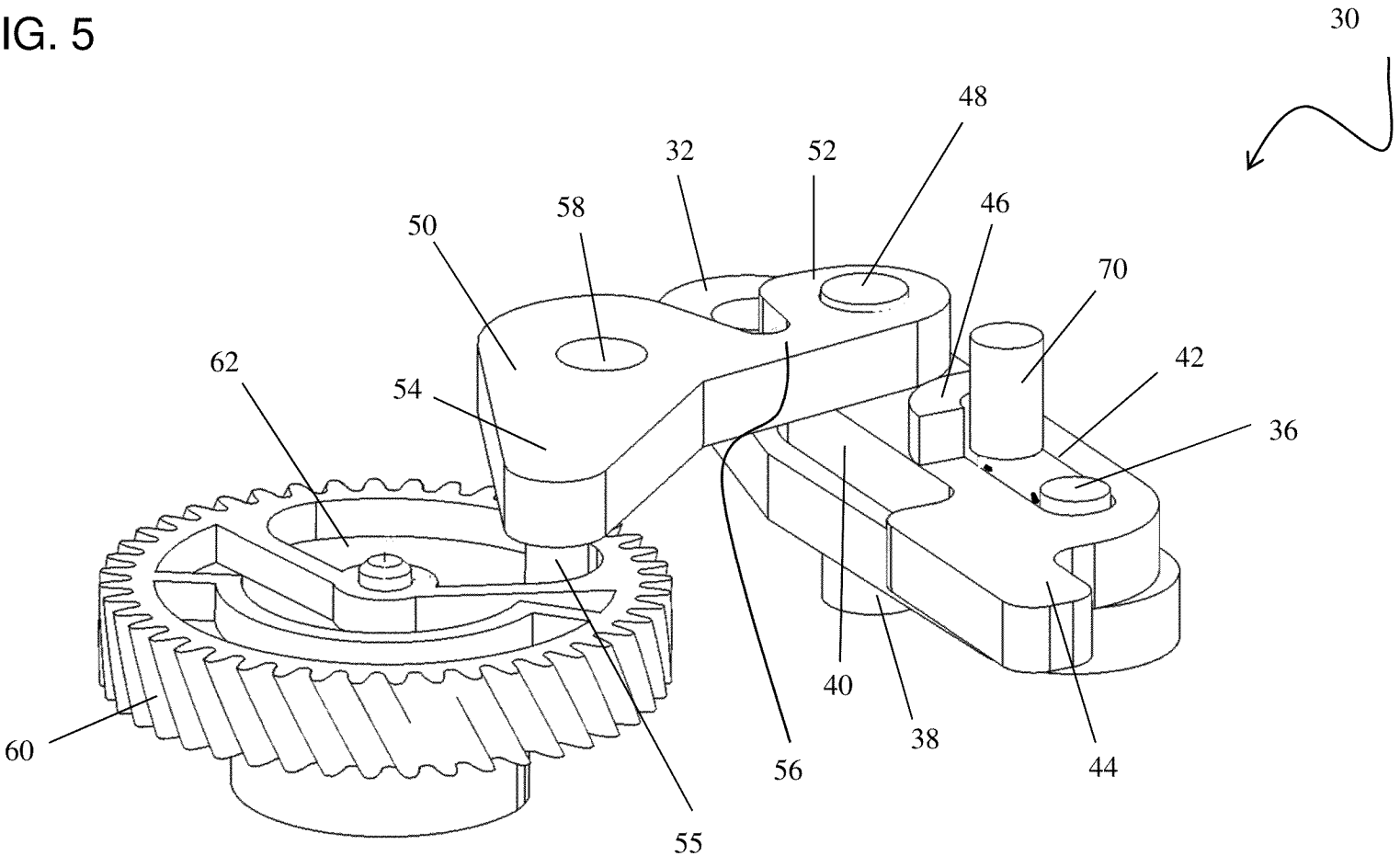
FIG. 5 is a perspective side view of the locking assembly of the present invention.

By releasing the handle 110, illustrated in FIG. 4, the release lever 32 is biased back into its original, non-actuated position. Rotation of the release lever 32 to a non-actuated position causes the intermittent lever 40 to rotate back to a first position. The blocking member 46 and the blocking pin 70 remain engaged until the intermittent lever 40 reaches the first position where the foot portion 44 is substantially aligned for engagement with the protrusion 86 of the detent lever 82. This prevents the latch 20 from malfunctioning because the intermittent lever 40 is unable to slide into an unlocked position when the foot portion 44 of the intermittent lever 40 is not aligned with the detent lever 82, such as when the foot portion 44 is adjacent the opposite side of protrusion 86 for example. Once the blocking member 46 separates from the blocking pin 70, the intermittent lever 40 may slide relative to the release lever 32, thereby allowing the locking lever 50 to rotate. Since the second end 54 of the locking lever 50 is held stationary by a sidewall of opening 62, the biasing force stored within the compressed locking lever 50 acts on the intermittent lever 40 causing the intermittent lever 40 to slide relative to the release lever 32 into the unlocked position. Therefore, the latch 20 may be unlocked by energizing the motor 66 even when a force is being applied to the handle 110. To open the latch 20, a second force is applied to the handle 110, such that the foot portion 44 of the intermittent lever 40 causes the detent lever 82 to disengage the fork bolt 90.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A latch comprising:

a one-piece locking lever pivotally mounted to the latch;

an intermittent lever pivotally coupled to the locking lever proximate to a first end of the locking lever, wherein movement of the locking lever causes a corresponding movement of the intermittent lever;

a gear pivotally coupled to the locking lever proximate to a second end of the locking lever, wherein rotational movement of the gear causes movement of the locking lever; and wherein the locking lever is formed from a resilient material and has an area of reduced thickness between the first end and the second end of the locking lever such that the second end of the locking lever is movable with respect to the first end of the locking lever and movement of the second end of the locking lever with respect to the first end of the locking lever creates a biasing force in the locking lever.

2. The latch of claim 1 further comprising:

a release lever rotatably mounted to the latch, the release lever having a retaining pin located within an elongated opening of the intermittent lever such that the intermittent lever is slidably coupled to the release lever; and a handle coupled to the release lever such that application of a force to the handle causes the release lever and the intermittent lever to rotate.

3. The latch according to claim 1, further comprising:

a blocking pin; and a blocking member extending from a surface of the intermittent lever, such that the blocking member is configured to engage the blocking pin to limit rotation of the intermittent lever about the first end of the locking lever.

4. The latch according to claim 3, wherein the blocking pin is integrally formed with a housing of the latch.

5. The latch according to claim 3, wherein the blocking member prevents disengagement of the blocking member from the blocking pin when the intermittent lever is not aligned with a protrusion of an adjacent detent lever.

6. The latch according to claim 1, wherein the intermittent lever includes a foot portion disposed adjacent an end.

7. The latch according to claim 6, further comprising:

a rotatable fork bolt;

a detent lever configured to engage the fork bolt, wherein the detent lever is moved out of engagement with the fork bolt by the foot portion of the intermittent lever.

8. The latch according to claim 1, wherein the gear is coupled to a motor.

9. A method for preventing misalignment of a latch during an unlock operation comprising:

moving a release lever from a non-actuated position to an actuated position wherein a blocking member of an intermittent lever operatively coupled to the release lever engages a blocking pin to prevent misalignment of the intermittent lever with respect a detent lever, when the release lever is moved to the actuated position and when the intermittent lever is in a first position thereby causing the intermittent lever to be in a second position wherein the blocking member engages the blocking pin;

compressing a one-piece locking lever operatively coupled to the intermittent lever from a first position to a second position, wherein the locking lever is formed from a resilient material and has an area of reduced thickness between a first end and a second end of the locking lever, and wherein the first end of the locking lever moves toward the second end of the locking lever to create a biasing force in a first direction;

returning the intermittent lever to the first position; and sliding the intermittent lever from the first position to an unlocked position via the biasing force.

10. The method for preventing misalignment of a latch during an unlock operation according to claim 9, wherein the locking lever is compressed by energizing a motor when the blocking member is engaged with the blocking pin.

11. The method for preventing misalignment of a latch during an unlock operation according to claim 9, wherein the geometry of the blocking member prevents disengagement of the blocking member from the blocking pin before the intermittent lever is aligned for engagement with the detent lever.

12. The method for preventing misalignment of a latch during an unlock operation according to claim 9, wherein movement of the release lever from the actuated position to the non-actuated position causes the intermittent lever to rotate to into alignment with the detent lever.

13. The method for preventing misalignment of a latch during an unlock operation according to claim 9, wherein application of a force to a handle operatively coupled to the release lever causes the release lever to move between the non-actuated position and the actuated position.

14. A latch comprising:

a one-piece locking lever pivotally mounted to a housing of the latch;

an intermittent lever pivotally coupled to the locking lever proximate to a first end of the locking lever, wherein movement of the locking lever causes a corresponding movement of the intermittent lever;

a gear pivotally coupled to the locking lever proximate to a second end of the locking lever, wherein rotational movement of the gear causes movement of the locking lever;

a motor for rotating the gear;

a release lever pivotally mounted to the housing and operably coupled to a handle external to the housing, the intermittent lever being slidably mounted to the release lever via a pin integrally formed with the release lever;

wherein the locking lever is formed from a resilient material and has an area of reduced thickness between the first end and the second end of the locking lever such that the second end of the locking lever is movable with respect to the first end of the locking lever and movement of the second end of the locking lever with respect to the first end of the locking lever creates a biasing force in the locking lever; and wherein the biasing force in the locking lever causes movement of the intermittent lever with respect to the housing after the motor has been de-energized and the release lever has been rotated by the handle prior to rotational movement of the gear by the motor.

15. The latch according to claim 14, further comprising:

a blocking pin integrally formed with the housing; and a blocking member extending from the intermittent lever, the blocking member being configured to prevent movement of the intermittent lever to an unlocked position until the blocking member and the blocking pin are disengaged.

16. The latch according to claim 15, wherein the blocking member and the blocking pin disengage after the release lever rotates to a non-actuated position and the intermittent lever returns to a first position.

17. The latch according to claim 14, wherein the intermittent lever includes a foot portion disposed adjacent an end of the intermittent lever.

18. The latch according to claim 17, further comprising:

a rotatable fork bolt;

a detent lever configured to engage the fork bolt, wherein the detent lever is moved out of engagement with the fork bolt by the foot portion of the intermittent lever.

* * * * *